US012275565B2

(12) United States Patent
Box

(10) Patent No.: US 12,275,565 B2
(45) Date of Patent: Apr. 15, 2025

(54) DISPLAY READY PACKAGING

(71) Applicant: Cargill, Incorporated, Wayzata, MN (US)

(72) Inventor: Daren Box, Nebraska City, NE (US)

(73) Assignee: Cargill, Incorporated, Wayzata, MN (US)

( * ) Notice: Subject to any disclaimer, the term of this patent is extended or adjusted under 35 U.S.C. 154(b) by 0 days.

(21) Appl. No.: 17/769,515

(22) PCT Filed: Oct. 15, 2020

(86) PCT No.: PCT/US2020/055777
§ 371 (c)(1),
(2) Date: Apr. 15, 2022

(87) PCT Pub. No.: WO2021/076751
PCT Pub. Date: Apr. 22, 2021

(65) Prior Publication Data

US 2024/0217697 A1 Jul. 4, 2024

Related U.S. Application Data

(60) Provisional application No. 62/916,537, filed on Oct. 17, 2019.

(51) Int. Cl.
*B65D 5/54* (2006.01)
*B65D 5/00* (2006.01)
*B65D 5/468* (2006.01)

(52) U.S. Cl.
CPC ..... *B65D 5/54* (2013.01); *B65D 5/001* (2013.01); *B65D 5/5405* (2013.01); *B65D 5/4608* (2013.01)

(58) Field of Classification Search
CPC ..... B65D 5/16; B65D 5/001; B65D 5/5445; B65D 5/541; B65D 5/54; B65D 5/5408;
(Continued)

(56) References Cited

U.S. PATENT DOCUMENTS 2,294,965 A 9/1942 Davidson
2,685,400 A * 8/1954 MacArthur, Jr. ..... B65D 5/541 229/222

(Continued)

FOREIGN PATENT DOCUMENTS

DE 2949496 A1 * 6/1981
DE 3201054 A1 * 7/1983

(Continued)

OTHER PUBLICATIONS

Debatin Shipping Document Pockets: Announced [Aug. 11, 2017, online]. Site Vistited [Feb. 8, 2021, online]. Available from Internet URL: https://www.amazon.com/Debatin-522370-250-Shipping-C6-Dispenser-250-Neutral/dp/B00IWVRXKO (Year: 2017).

(Continued)

*Primary Examiner* — Nathan J Newhouse
*Assistant Examiner* — Phillip D Schmidt

(57) ABSTRACT

A shipping container is initially a substantially enclosed box for transport of product, and has a detachable portion comprising a removable section of the top panel that is no more than 35% of the area of the top panel, a major flap and side flaps adjacent to the major flap. The shipping container is convertible to a display container for display and access to the contents of the container at the point of product sale by removal of the detachable portion. A plurality of the display containers can be stably stacked for display even after removal of the detachable portion.

18 Claims, 7 Drawing Sheets

(58) Field of Classification Search
CPC ..... B65D 5/545; B65D 5/546; B65D 5/5475; B65D 2571/0058
USPC ..... 229/122, 160.2, 240–242
See application file for complete search history.

(56) References Cited

U.S. PATENT DOCUMENTS

| | | | | |
|---|---|---|---|---|
| 2,868,365 | A | 1/1959 | Paige | |
| 3,137,437 | A * | 6/1964 | Svensson | B65D 5/5445 229/210 |
| 3,167,240 | A | 1/1965 | Collura | |
| 3,254,793 | A | 6/1966 | Palmer | |
| 3,829,006 | A | 8/1974 | Spiegel | |
| 4,000,811 | A | 1/1977 | Hardison et al. | |
| 4,417,655 | A | 11/1983 | Forbes, Jr. | |
| 4,865,187 | A | 9/1989 | Zulauf | |
| 4,946,042 | A | 8/1990 | Ferreri et al. | |
| 5,167,324 | A | 12/1992 | Miller | |
| 5,398,869 | A | 3/1995 | Dickson et al. | |
| 5,622,309 | A * | 4/1997 | Matsuda | B65D 5/5425 229/122 |
| 6,135,289 | A | 10/2000 | Miller | |
| D454,784 | S | 3/2002 | Oram | |
| 6,386,368 | B1 | 5/2002 | Pirro | |
| 6,405,921 | B1 | 6/2002 | Cochrane | |
| 6,902,104 | B2 | 6/2005 | Holley, Jr. | |
| 7,451,878 | B2 | 11/2008 | Rochefort | |
| 7,658,318 | B2 | 2/2010 | Walsh | |
| D629,296 | S | 12/2010 | De Muynck | |
| 7,959,007 | B1 | 6/2011 | Ballentine et al. | |
| 8,376,141 | B2 | 2/2013 | Couture | |
| D696,107 | S | 12/2013 | Kimple et al. | |
| 8,740,053 | B2 | 6/2014 | Snyder | |
| 8,844,728 | B2 | 9/2014 | James | |
| D718,616 | S | 12/2014 | Palmer | |
| 8,973,811 | B2 | 3/2015 | McLeod et al. | |
| D738,202 | S | 9/2015 | Stone | |
| D746,672 | S | 1/2016 | McNamee | |
| D747,186 | S | 1/2016 | Palmer | |
| D778,721 | S | 2/2017 | Sanfilippo et al. | |
| D791,589 | S | 7/2017 | Remash | |
| D830,199 | S | 10/2018 | Ogata et al. | |
| D849,543 | S | 5/2019 | Augustyniak et al. | |
| 10,292,561 | B2 | 5/2019 | Gonzales et al. | |
| 10,576,718 | B2 | 3/2020 | Brown et al. | |
| 10,683,618 | B2 | 6/2020 | Pratt et al. | |
| D891,836 | S | 8/2020 | Silkaitis | |
| 10,786,404 | B2 | 9/2020 | Cheng et al. | |
| D900,638 | S | 11/2020 | Wettlaufer | |
| 2003/0116614 | A1 * | 6/2003 | Block | B65D 5/4291 206/268 |
| 2004/0099570 | A1 | 5/2004 | Cargile | |
| 2007/0029371 | A1 * | 2/2007 | Theelen | B65D 71/36 229/122 |
| 2010/0006456 | A1 | 1/2010 | Bevier | |
| 2012/0234724 | A1 | 9/2012 | James et al. | |
| 2013/0134211 | A1 | 5/2013 | Linkel | |
| 2013/0206828 | A1 | 8/2013 | Schomisch | |
| 2013/0213991 | A1 | 8/2013 | Harrelson | |
| 2013/0306718 | A1 | 11/2013 | Sumpmann et al. | |
| 2013/0312369 | A1 | 11/2013 | Maki | |
| 2013/0334295 | A1 | 12/2013 | Swenson | |
| 2015/0041363 | A1 | 2/2015 | Freeman | |
| 2017/0240346 | A1 | 8/2017 | Chatelain et al. | |
| 2019/0009946 | A1 | 1/2019 | Nixon et al. | |
| 2019/0322412 | A1 | 10/2019 | Couture et al. | |
| 2019/0344925 | A1 | 11/2019 | Block | |
| 2019/0367210 | A1 | 12/2019 | Smith | |
| 2020/0087018 | A1 | 3/2020 | Bourne | |
| 2023/0174268 | A1 * | 6/2023 | Barstow | B65D 5/542 426/115 |

FOREIGN PATENT DOCUMENTS

| | | | |
|---|---|---|---|
| DE | 202008003319 | U1 | 5/2008 |
| EP | 2944459 | B1 | 2/2017 |
| WO | 2016134118 | W | 8/2016 |

OTHER PUBLICATIONS

Keto Shopping List at Sams Club: Announced [Jun. 9, 2019, online]. Site Visited [Feb. 8, 2021, online]. Available from Internet URL: https://everydayshortcut.com/keto-shopping-list-at-sams-club/ (Year: 2019).

* cited by examiner

DISPLAY READY PACKAGING

CROSS REFERENCE TO RELATED APPLICATIONS

This application is a national phase application of PCT/US2020/055777, filed 15 Oct. 2020, entitled DISPLAY READY PACKAGING, which claims the benefit of U.S. Provisional Patent Application No. 62/916,537, filed 17 Oct. 2019, entitled DISPLAY READY PACKAGING which are hereby incorporated by reference in their entirety.

FIELD

The present invention relates to packaging. More specifically, the present application relates to display ready packaging.

BACKGROUND

In normal commerce, individual packaged products are shipped in a larger shipping box, which is typically an "RSC box." "RSC" stands for "regular slotted carton" or "Regular Slotted Container" and is the typical box having the construction as shown in FIG. 1. RSC box 100 has two larger side panels ("major panels") 102 and 104, and two smaller side panels ("minor panels"), one of which is shown in FIG. 1 as minor panel 106. Each of the major and minor panels which extends and can be folded at a 90 degree angle to provide four flaps on the bottom box opening and four flaps at the top opening. On a rectangular box, the flaps extending from major panels 102 and 104 are the major flaps 110 and 112, and the flaps extending from the minor panels are minor flaps 114 and 116. A similar typical standard RSC box 200 is shown in FIG. 2, wherein major flaps 210 and 212 have the same size and meet in the middle, where they are typically taped together using plastic or water-activated tape to close RSC box 200. At times, store personnel merely open the box for the customer to access the product themselves. Alternatively, the store personnel may tear or cut off the major and minor flaps at the top of the box for easier access to the product.

An alternative box configuration is shown in FIG. 3, wherein box 300 is an adapted RSC box that is provided with an open top 311 without major or minor flaps, and instead is provided with a separate cover 321 that is easily removed for access to product inside box 300.

Boxes that have been used in the past are primarily designed only to ship products from one place to another, and are not well suited to properly function as a display case. Boxes are usually stacked in the store, and the contents of only the top box are visible to the consumer, even if all of the boxes in the stack have been opened. Alternative carton configurations, such as described in U.S. Pat. No. 7,658,318 comprise a pivotable lid in a top portion of the carton. When opened, the lid separates from the inner blank and can be pivoted between open and closed positions. Thus, as above, the contents of only the top box are visible to the consumer when this carton is displayed in a stack.

U.S. Pat. No. 6,405,921, describes a perforated carton adapted for transporting and displaying products comprising a removable top panel wherein when the carton is separated, the only portion of the carton remaining in the top panel is one or more top corners formed respectively at the intersection of two of the side panels and the top panel. The top portion of the carton thus is almost completely removed, lessening the structural support ability of the carton if the opened cartons are stacked. Moreover, removal of the top panel and side panel portions is complex.

U.S. Pat. No. 7,451,878 describes a shipping container for facilitating the conversion of the shipping container into a dispensing or all-around display container from formed an outer blank having a centrally positioned bottom wall, front and rear walls, top panels, side flaps and an interior divider structure for structural stacking support both during shipping and display modes.

SUMMARY

A shipping container is provided that is convertible to a display container for display of product contained in the container. The shipping container is initially a substantially enclosed box for transport of product. The shipping container has a detachable portion, which comprises a removable section of the top panel that is no more than 35% of the area of the top panel, a major flap and side flaps adjacent to the major flap. This detachable portion may be removed for display and access to the contents of the container at the point of product sale. In an aspect, the top panel of the shipping container is provided with a line of weakness that defines the removable section of the top panel for easy removal from the balance of the container. In an aspect, the major flap of the shipping container is also provided with lines of weakness for easy removal from the balance of the container. In an aspect, side flaps adjacent to the major flap of the shipping container are also provided with lines of weakness for easy removal from the balance of the container. The detachable portion as defined provides exceptional access to the product displayed in the container, even when a plurality of containers is stacked on each other. Moreover, the present configuration of the container after the detachable portion is removed permits excellent visibility of the contents. When the thus opened container is in the store, even when stacked one upon the other, the consumer can easily see the product contained in the box and select same for purchase.

Additionally, the detachable portion as defined is configured such that the parts of the shipping container that remain after removal of the detachable portion provides excellent support structure to permit stable stacking of a plurality of containers after removal of the detachable portion. This stability of a stack of containers is observed even when the detachable portion of the containers is removed from all containers in the stack.

In an aspect, the shipping container comprises a top panel, a bottom panel, a first side panel bridging the top panel and the bottom panel, and a second side panel bridging the top panel and the bottom panel. A first major flap and a second major flap extend from opposing sides of the top panel. A first minor flap and a second minor flap extend from opposing sides of the bottom panel. In an embodiment, the first major flap is longer than the first minor flap. In an embodiment, both the first and second major flaps are longer than the first and second minor flaps. A first side flap and a second side flap extend from opposing sides of the first side panel; and a third side flap and a fourth side flap extend from opposing sides of the second side panel. The container comprises a detachable portion comprising the first major flap, a removable section of the top panel that is no more than 35% of the area of the top panel, and a removable section of the first and third side flaps. The detachable portion is separable from the container along a plurality of lines of weakness. The first and second side panels are not separable from the container.

In an aspect, an additional perforation or zipper pull is provided on the top panel and/or the major flap to assist in removal of the detachable portion of the container. In an aspect, a thumb hole is provided at the beginning of the zipper pull.

In an aspect, the shipping container is filled with product by first partially assembling the container, leaving the flaps open on one end for receiving product. The product is loaded into the container and the end flaps are closed. In an aspect, the product is provided in individual packages, such as boxes or trays, with labels oriented to be visible in the container after removal of the detachable portion of the container. In an aspect, the product is packed with the shipping container oriented with the first major flap and the first minor flap on top, loaded from the top, and shipped in the same vertical orientation. When the shipping container arrives at the store location where display of product is desired, the container is rotated so that the major flaps are reoriented to the side of the container and the bottom panel rests on a horizontal surface. The detachable portion is then removed from the shipping container for conversion of the shipping container to a display container for display of product contained in the container.

When in use for display purposes, the shipping container is positioned so that the bottom panel rests on a horizontal surface during display, and the top panel is on top. The first and second major flaps extend downward from the top panel (before removal of the first major flap). Because the first major flap is longer than the first minor flap, the opening providing access to the product being displayed in the container after removal of the detachable portion is relatively large to facilitate removal of the product. The top panel and the major and minor flaps on one side of the box are perforated so that when the box is in position for display, the upper major flap is removed with a portion of the corresponding top panel and the first and third side flaps.

It should be noted that no aspect of the first or second side panels is included in the detachable portion, and that the first and second side panels are not separable from the container. This is because the panels provide structural support for the container after it has been converted to a display container configuration. This structural support aspect is particularly important when the container is stacked when in the display configuration. In an aspect, the resulting display container may be securely stacked in multiple levels. In an aspect, the containers are configured with strength characteristics using ordinary packaging material so that from two to five containers may be stacked after removal of the detachable portion without collapse of the stack. In an aspect, the containers are configured with strength characteristics using ordinary packaging material so that from two to eight containers may be stacked after removal of the detachable portion without collapse of the stack. In an aspect, the containers are configured with strength characteristics using ordinary packaging material so that from two to ten containers may be stacked after removal of the detachable portion without collapse of the stack.

The shipping container in an aspect is easy to fabricate, assemble, fill with product, and ship. The retailer can easily convert the shipping container to a display container and effectively display container without the need to use shelving if desired. Because of the design of the display container after removal of the detachable portion, the products displayed in the display container are visible and are readily accessed by the customer. Moreover, the display container has sufficient structural integrity even after removal of the detachable portion to make it possible to stack a plurality of display containers.

BRIEF DESCRIPTION OF THE DRAWINGS

The accompanying drawings, which are incorporated in and constitute a part of this application, illustrate several aspects of the invention and together with a description of the embodiments serve to explain the principles of the invention. A brief description of the drawings is as follows.

DETAILED DESCRIPTION

The aspects of the present invention described below are not intended to be exhaustive or to limit the invention to the precise forms disclosed in the following detailed description. Rather a purpose of the aspects chosen and described is by way of illustration or example, so that the appreciation and understanding by others skilled in the art of the general principles and practices of the present invention can be facilitated.

In the figures, unless otherwise noted, the solid lines on the interior of a figure represent cuts, edges, fold lines or points of inflection (like a ridge, crease or inwardly or outwardly projecting gusset), and broken or dashed lines indicate lines of weakness such as score lines, perforations or similar structure to facilitate separation of one portion of the container from another by a user.

For purposes of the present discussion, a portion of the container is considered to not be separable from the rest of the container (such as wherein the first and second side panels are not separable from the container) if one portion of the container cannot be removed from another by a user without the use of a knife or similar tool.

Figure 1:
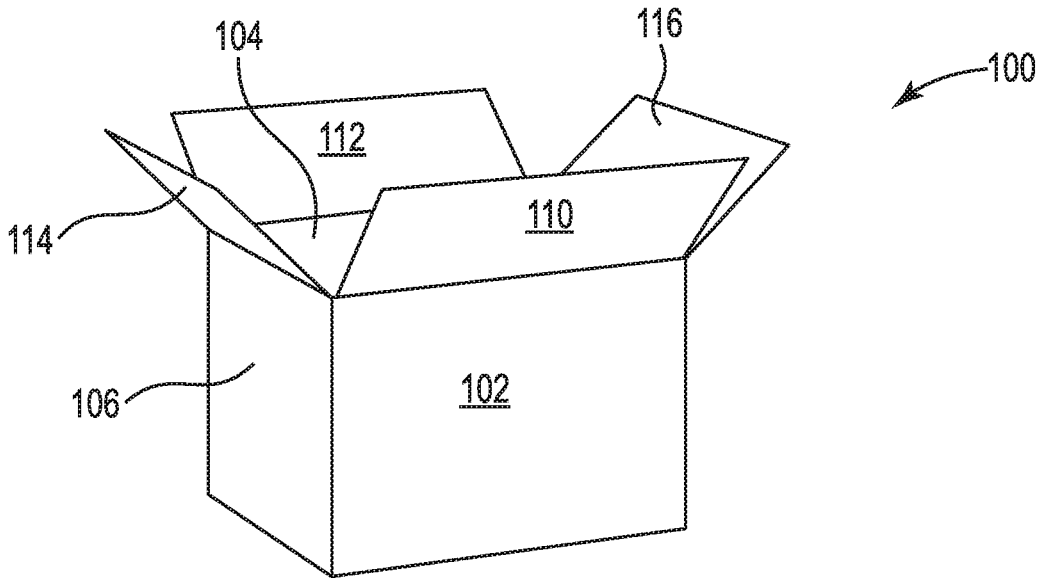
Fig. 1 PRIOR ART
FIG. 1 is a perspective view of a prior art RSC box.
Figure 2:
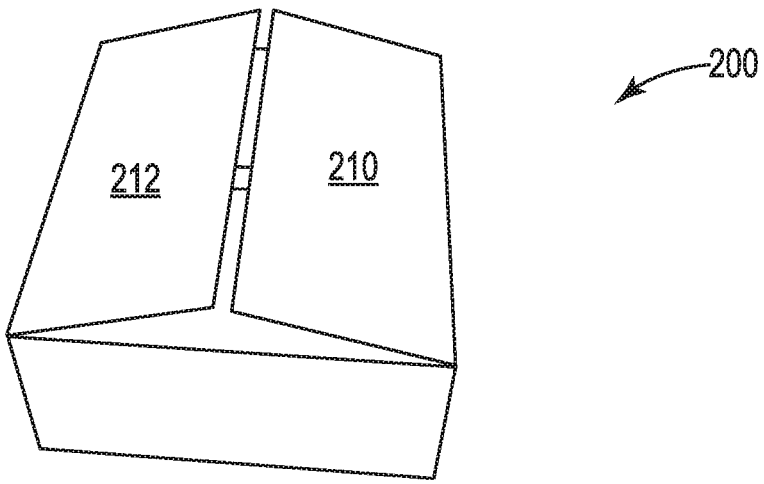
Fig. 2 PRIOR ART
FIG. 2 is a perspective view of a prior art RSC box.
Figure 3:
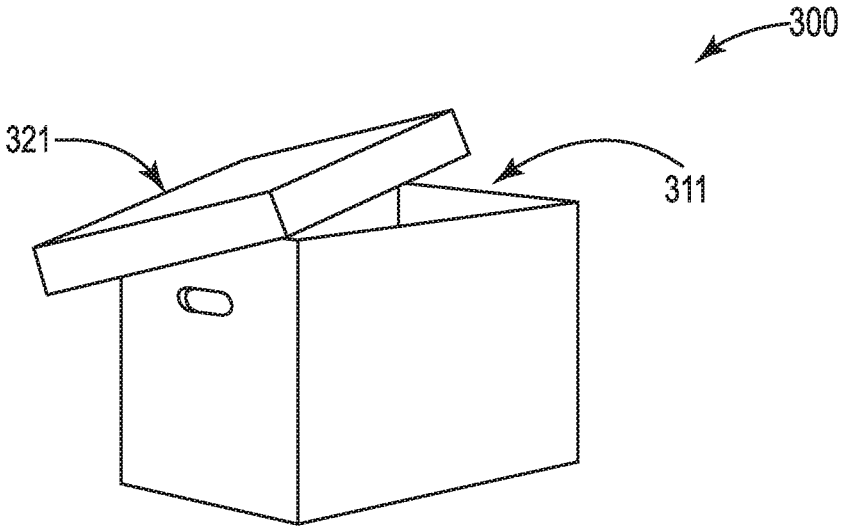
Fig. 3 PRIOR ART
FIG. 3 is a perspective view of a prior art RSC box.
Figure 4:
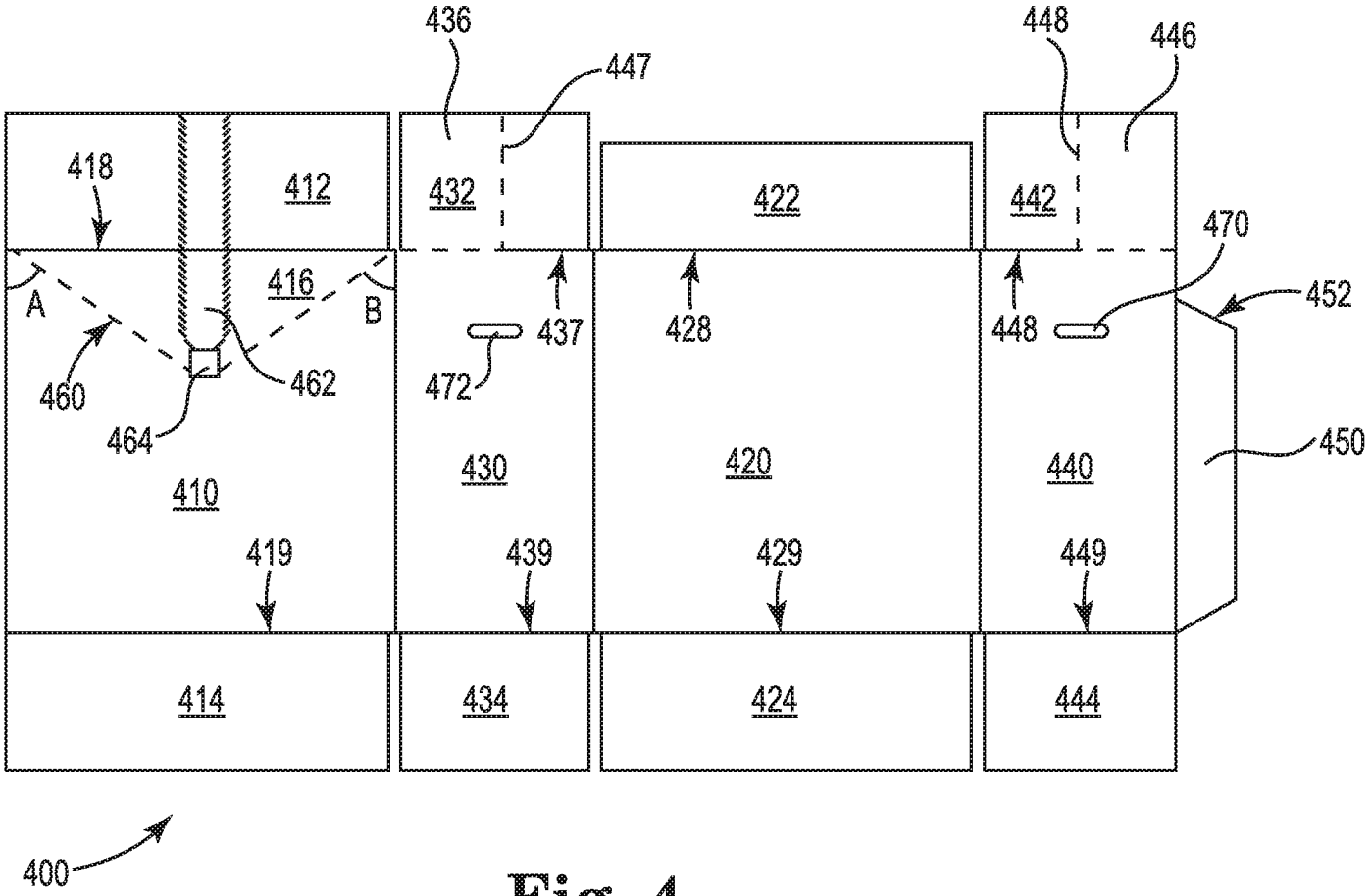
FIG. 4 is a plan of a blank of an embodiment of a shipping container convertible to a display container.

Turning now to the Figures, FIG. 4 is a plan of a blank 400 of an embodiment of a shipping container convertible to a display container. Blank 400 includes top panel 410, bottom panel 420, first side panel 430 bridging top panel 410 and bottom panel 420, and second side panel 440 bridging top panel 410 and bottom panel 420. First major flap 412 is connected to and extends from top panel 410 at flap fold line 418, and second major flap 414 is connected to and extends from top panel 410 at flap fold line 419. First minor flap 422 is connected to and extends from bottom panel 420 at flap fold line 418, and second minor flap 424 is connected to and extends from bottom panel 420 at flap fold line 429. First major flap 412 is longer (i.e. extends farther from flap fold line 418) than first minor flap 422. Because first major flap 142 is longer than first minor flap 422, the opening providing access to the product being displayed in the container when the container has been converted to a display container is relatively large to facilitate removal of the product.

In an aspect, the first major flap and first minor flap as described herein have relative sizes such that the length ratio of the first major flap to the first minor flap is from 1:0.4 to 1:0.9. In an aspect, the length ratio of the first major flap to the first minor flap is from 1:0.5 to 1:0.8. In an aspect, the length ratio of the first major flap to the first minor flap is from 1:0.6 to 1:0.7. In an aspect, the second major flap and second minor flap as described herein have relative sizes such that the length ratio of the second major flap to the second minor flap is from 1:0.4 to 1:0.9. In an aspect, the length ratio of the second major flap to the second minor flap is from 1:0.5 to 1:0.8. In an aspect, the length ratio of the second major flap to the second minor flap is from 1:0.6 to 1:0.7. In an aspect, the length ratio of the second major flap to the second minor flap is from 1:0.4 to 0.4:0.1. In an aspect, the length ratio of the second major flap to the second minor flap is 1:1.

First side flap 432 is connected to and extends from first side panel 430 at flap fold line 437, and second side flap 432 is connected to and extends from first side panel 430 at flap fold line 439. Third side flap 442 is connected to and extends from second side panel 440 at flap fold line 448, and a fourth side flap 444 is connected to and extends from second side panel 440 at flap fold line 449. First, second, third and fourth side flaps may be the same or different lengths. In an aspect, first, second, third and fourth side flaps are the same length (i.e., extend the same length from their respective flap fold lines).

Blank 400 comprises a detachable portion comprising first major flap 412; a removable section 416 of top panel 410 that is no more than 35% of the area of the top panel; removable section 436 of first side flap 432 defined by line of weakness 447; removable section 446 of third side flap 442 defined by line of weakness 448. In an aspect, the removable section of the top panels as described herein are from about 10% to about 35% of the area of the top panel. In an aspect, the removable section of the top panels as described herein are from about 15% to about 35% of the area of the top panel. In an aspect, the removable section of the top panels as described herein are from about 20% to about 35% of the area of the top panel.

Removable section 416 of top panel 410 defined by line of weakness 460. An additional perforation line or zipper pull 462 is provided on top panel 410 and optionally continuing on major flap 412 to assist in removal of the portions of the container. Optional thumb hole 464 is provided at the beginning of zipper pull 462 to facilitate gripping the zipper pull for removal of this section of the detachable portion. Alternatively, a zipper pull tab may be provided at the beginning of zipper pull 462. It should be noted that no aspect of first side panel 430 or second side panel 440 is included in the detachable portion, and first side panel 430 and second side panel 440 are not separable from the container. This is because first side panel 430 and second side panel 440 provide structural support for the container after it has been converted to a display container configuration. This structural support aspect is particularly important when the container is stacked when in the display configuration. The resulting display container may be securely stacked in multiple levels, such as two to ten containers high, all with the detachable portion being removed, without concern for collapse of the stack as described above.

In an aspect, the removable section of the top panels as described herein is defined by a line of weakness on the top panel that extends from the intersection of top panel with the side panels and first major flap at angles (A and B in the figures) from the edge of the side panels of greater than about 10 degrees. This angle provides horizontal structure near the opening of the container after removal of the detachable portion that affords enhanced structural stability to the display container. In an aspect, the line of weakness on the top panel extends from the intersection of top panel with the side panels and first major flap at angles from the edge of the side panels that are from about 10 degrees to about 75 degrees. In an aspect, the line of weakness on the top panel extends from the intersection of top panel with the side panels and first major flap at angles from the edge of the side panels that are from about 20 degrees to about 60 degrees. In an aspect, the line of weakness on the top panel extends from the intersection of top panel with the side panels and first major flap at angles from the edge of the side panels that are from about 30 degrees to about 60 degrees. In an aspect, the line of weakness on the top panel extends from the intersection of top panel with the side panels and first major flap at angles from the edge of the side panels that are from about 35 degrees to about 55 degrees. The angles of the line of weakness on the top panel extending from the intersection of top panel with the side panels and first major flap at angles from the edge of the side panels may be the same or different. In an aspect, the angles of the line of weakness on the top panel extending from the intersection of top panel with the side panels and first major flap at angles from the edge of the side panels are the same.

In an aspect, the line of weakness on the top panel extending from the intersection of top panel with the side panels and first major flap at angles from the edge of the side panels are straight lines. In an aspect, the removable section of the top panels as described herein has the shape of a triangle. In an aspect, the removable section of the top panels as described herein has the shape of a trapezoid. In an aspect, the removable section of the top panels as described herein has the shape of an isosceles trapezoid. In an aspect, the lines of weakness join to form discrete angles. In an aspect, the lines of weakness join in a gradual curve, i. e. form rounded corners. In an aspect, the line of weakness on the top panel extending from the intersection of top panel with the side panels and first major flap at angles from the edge of the side panels are not straight lines. In an aspect, the removable section of the top panels as described herein has the shape of a partial circle.

The shipping container is formed by folding top panel 410, first side panel 430, bottom panel 420, second side panel 440, and edge panel 450 to form a completed box structure, with edge panel 450 overlapping top panel 410. Edge panel 450 is affixed to top panel 410, e.g., by gluing. Note that edge panel is angled at front edge 452 to avoid interference with operation of line of weakness 460 for removal of the detachable portion.

In an aspect, completion of the assembly can be carried out by enclosing the side of the shipping container comprising the detachable portion, loading product, and then enclosing the opposing side of the shipping container. In this aspect, first side flap 432 and third side flap 442 are folded in, and then first major flap 412 and first minor flap 422 are likewise folded in. First major flap 412 and first minor flap 422 are affixed to first side flap 432 and third side flap 442, e.g., by gluing. The lengths of first major flap 412 and first minor flap 422 in particular are selected so that first major flap 412 and first minor flap 422 do not overlap, but at most abut at their free edges. In an aspect, the free edges of first major flap 412 and first minor flap 422 do not contact each other.

Product is loaded into the thus-formed open ended shipping container. In this aspect, the labels on the product providing identifying information are in an aspect positioned face-down in the open ended shipping container.

After loading of the product, second side flap 434 and fourth side flap 444 are folded in, and then second major flap 414 and second minor flap 424 are likewise folded in. Second major flap 414 and second minor flap 424 are affixed to second side flap 434 and fourth side flap 444, e.g., by gluing, or by taping. In an aspect, the lengths of second major flap 414 and second minor flap 424 are selected so that second major flap 414 and second minor flap 424 partially or completely overlap. Partial or complete overlap of second major flap 414 and second minor flap 424 provides enhanced strengthening of the shipping container, which is particularly desirable after removal of the detachable for use as a display container. In an aspect, the lengths of second major flap 414 and second minor flap 424 are selected so that second major flap 414 and second minor flap 424 do not overlap, but at most abut at their free edges. In an aspect, the free edges of second major flap 414 and second minor flap 424 do not contact each other. This aspect is advantageous in providing a simplified container fabrication process that uses less packaging materials than in the embodiment where the flaps overlap.

In an aspect, the order of closing side flaps as described above is reversed. In this aspect, completion of the assembly can be carried out by enclosing the side of the shipping container that does not comprise the detachable portion, loading product, and then enclosing the opposing side of the shipping container that does comprise the detachable portion. More specifically, in this aspect, second side flap 434, fourth side flap 444, second major flap 414, and second minor flap 424 are folded in and affixed, and the product is loaded. In this aspect, the labels on the product providing identifying information are in an aspect positioned face-up in the open ended shipping container. This aspect has the additional advantage that the product in the individual packages is always maintained in a "label up" orientation during manufacture and shipping, so that any settling of product that may occur will have a minimal effect on the appearance of the product. After loading of the product, first side flap 432, third side flap 442, first major flap 412 and first minor flap 422 are folded in and affixed.

First side panel 430 and second side panel 440 are optionally provided with oblong openings (or slots) 470, 472 to facilitate handling of the shipping. In an aspect, the openings provide an ergonomic grip, e.g. by the fingers, for handling.

Figure 5:
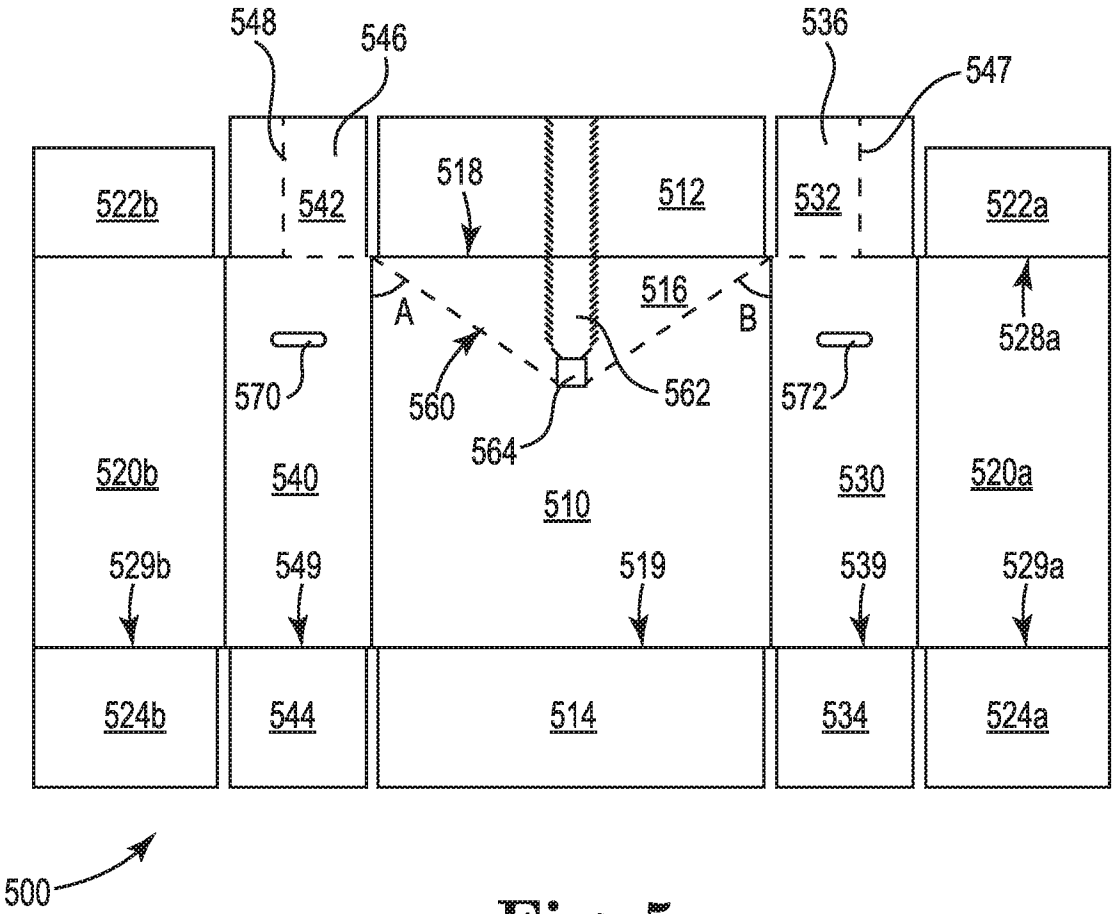
FIG. 5 is a plan of a blank of an embodiment of a shipping container convertible to a display container.

FIG. 5 is a plan of a blank 500 of an embodiment of a shipping container convertible to a display container. Blank 500 includes top panel 510, first bottom panel 520*a*, second bottom panel 520*b*, first side panel 530 bridging top panel 510 and first bottom panel 520*a*, and second side panel 540 bridging top panel 510 and second bottom panel 520*b*. First major flap 512 is connected to and extends from top panel 510 at flap fold line 518, and second major flap 514 is connected to and extends from top panel 510 at flap fold line 519. First minor flap half 522*a* is connected to and extends from first bottom panel 520*a* at flap fold line 528*a*, and second minor flap half 524*a* is connected to and extends from first bottom panel 520*a* at flap fold line 529*a*. Likewise, third minor flap half 522*b* is connected to and extends from second first bottom panel 520*b* at flap fold line 528*b*, and fourth minor flap half 524*b* is connected to and extends from bottom panel 520*b* at flap fold line 529*b*. First major flap 512 is longer (i.e. extends farther from flap fold line 518) than first minor flap half 522*a* and third minor flap half 522*b*. Because first major flap 142 is longer than first minor flap half 522*a* and third minor flap half 522*b*, the opening providing access to the product being displayed in the container when the container has been converted to a display container is relatively large to facilitate removal of the product.

First side flap 532 is connected to and extends from first side panel 530 at flap fold line 537, and second side flap 532 is connected to and extends from first side panel 530 at flap fold line 539. Third side flap 542 is connected to and extends from second side panel 540 at flap fold line 548, and a fourth side flap 544 is connected to and extends from second side panel 540 at flap fold line 549. First, second, third and fourth side flaps may be the same or different lengths. In an aspect, first, second, third and fourth side flaps are the same length (i.e., extend the same length from their respective flap fold lines).

Blank 500 comprises a detachable portion comprising first major flap 512; a removable section 516 of top panel 510 that is no more than 35% of the area of the top panel; removable section 536 of first side flap 532 defined by line of weakness 547; removable section 546 of third side flap 542 defined by line of weakness 548. Removable section 516 of top panel 510 defined by line of weakness 560. An additional perforation line or zipper pull 562 is provided on top panel 510 and optionally continuing on major flap 512 to assist in removal of the portions of the container. Optional thumb hole 564 is provided at the beginning of zipper pull 562 to facilitate gripping the zipper pull for removal of this section of the detachable portion. Alternatively, a zipper pull tab may be provided at the beginning of zipper pull 562. It should be noted that no aspect of first side panel 530 or second side panel 540 is included in the detachable portion, and first side panel 530 and second side panel 540 are not separable from the container. This is because first side panel 530 and second side panel 540 provide structural support for the container after it has been converted to a display container configuration. This structural support aspect is particularly important when the container is stacked when in the display configuration. The resulting display container may be securely stacked in multiple levels, such as two to ten containers high, all with the detachable portion being removed, without concern for collapse of the stack.

The shipping container is formed by folding top panel 510, first side panel 530, first bottom panel 520*a*, second side panel 540, and second bottom panel 520*b* to form a completed box structure. First bottom panel 520*a* and second bottom panel 520*b* in an aspect overlap partially or completely, are affixed to each other, e.g., by gluing or taping.

In an aspect, the width of first bottom panel 520*a* and second bottom panel 520*b* are selected so that first bottom panel 520*a* and second bottom panel 520*b* do not overlap, but at most abut at their free edges. In an aspect, the free edges of first bottom panel 520*a* and second bottom panel 520*b* do not contact each other. In these aspects, first bottom panel 520*a* and second bottom panel 520*b* are affixed to each other by appropriate techniques, such as by gluing or taping.

In an aspect, completion of the assembly can be carried out by enclosing the side of the shipping container comprising the detachable portion, loading product, and then enclosing the opposing side of the shipping container. In this aspect, first side flap 532 and third side flap 542 are folded in, and then first major flap 512 and first minor flap half 522*a* and fourth minor flap half 524*b* are likewise folded in. First major flap 512 and first minor flap half 522*a* and fourth minor flap half 524*b* are affixed to first side flap 532 and third side flap 542, e.g., by gluing. The lengths of first major flap 512 and first minor flap half 522*a* and fourth minor flap half 524*b* in particular are selected so that first major flap 512 and first minor flap half 522*a* and fourth minor flap half 524*b* do not overlap, but at most abut at their free edges. In an aspect, the free edges of first major flap 512 and first minor flap half 522*a* and fourth minor flap half 524*b* do not contact each other.

Product is loaded into the thus-formed open ended shipping container. In this aspect, the labels on the product providing identifying information are in an aspect positioned face-down in the open ended shipping container.

After loading of the product, second side flap 534 and fourth side flap 544 are folded in, and then second major flap 514, second minor flap half 524*a* and fourth minor flap half 524*b* are likewise folded in. Second major flap 514, second minor flap half 524*a*, and fourth minor flap half 524*b* are affixed to second side flap 534 and fourth side flap 544, e.g., by gluing, or by taping. In an aspect, the lengths of second major flap 514 and second minor flap half 524*a* and fourth minor flap half 524*b* are selected so that second major flap 514 and second minor flap half 524*a* and fourth minor flap half 524*b* partially or completely overlap. Partial or complete overlap of second major flap 514 and second minor flap half 524*a* and fourth minor flap half 524*b* provides enhanced strengthening of the shipping container, which is particularly desirable after removal of the detachable for use as a display container. In an aspect, the lengths of second major flap 514 and second minor flap half 524*a* and fourth minor flap half 524*b* are selected so that second major flap 514 and second minor flap half 524*a* and fourth minor flap half 524*b* do not overlap, but at most abut at their free edges. In an aspect, the free edges of second major flap 514 and second minor flap half 524*a* and fourth minor flap half 524*b* do not contact each other. This aspect is advantageous in providing a simplified container fabrication process that uses less packaging materials than in the embodiment where the flaps overlap.

In an aspect, the order of closing side flaps as described above is reversed. In this aspect, completion of the assembly can be carried out by enclosing the side of the shipping container that does not comprise the detachable portion, loading product, and then enclosing the opposing side of the shipping container that does comprise the detachable portion. More specifically, in this aspect, second side flap 534, fourth side flap 544, second major flap 514, and second minor flap half 524*a* and fourth minor flap half 524*b* are folded in and affixed, the product is loaded. In this aspect, the labels on the product providing identifying information are in an aspect positioned face-up in the open ended shipping container. This aspect has the additional advantage that the product in the individual packages is always maintained in a "label up" orientation during manufacture and shipping, so that any settling of product that may occur will have a minimal effect on the appearance of the product. After loading of the product, first side flap 532, third side flap 542, first major flap 512 and first minor flap half 522*a* and fourth minor flap half 524*b* are folded in and affixed.

First side panel 530 and second side panel 540 are optionally provided with oblong openings (or slots) 570, 572 to facilitate handling of the shipping container. In an aspect, the openings provide an ergonomic grip, e.g. by the fingers, for handling.

Figure 6:
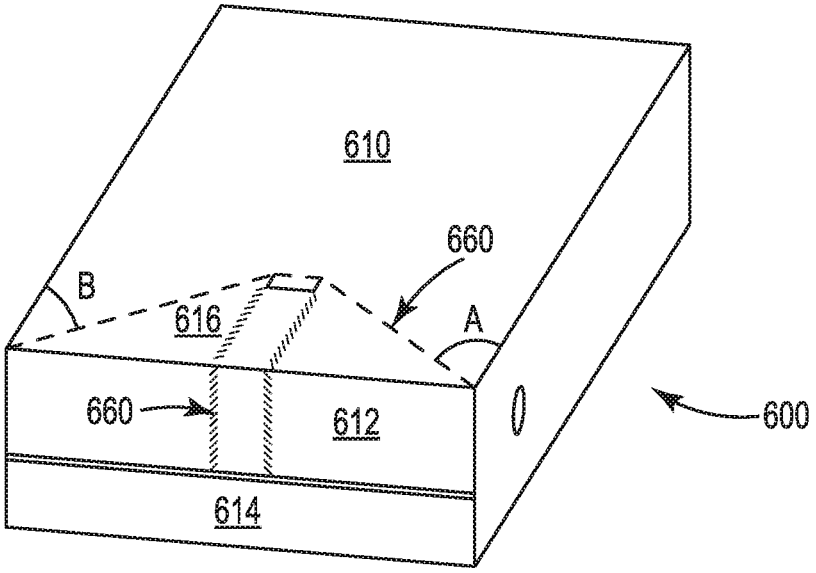
FIG. 6 is a perspective view of an embodiment of a shipping container after assembly.

FIG. 6 a perspective view of an embodiment of a shipping container 600 after assembly. Removable section 616 of top panel 610 is defined by line of weakness 660. Zipper pull 662 is provided on top panel 610 and continuing on major flap 612 to assist in removal of the portions of the container. After removal of removable section 616 and major flap 612, second major flap 614 remains connected to shipping container 600 and helps retain product displayed within the shipping container 600.

Figure 7:
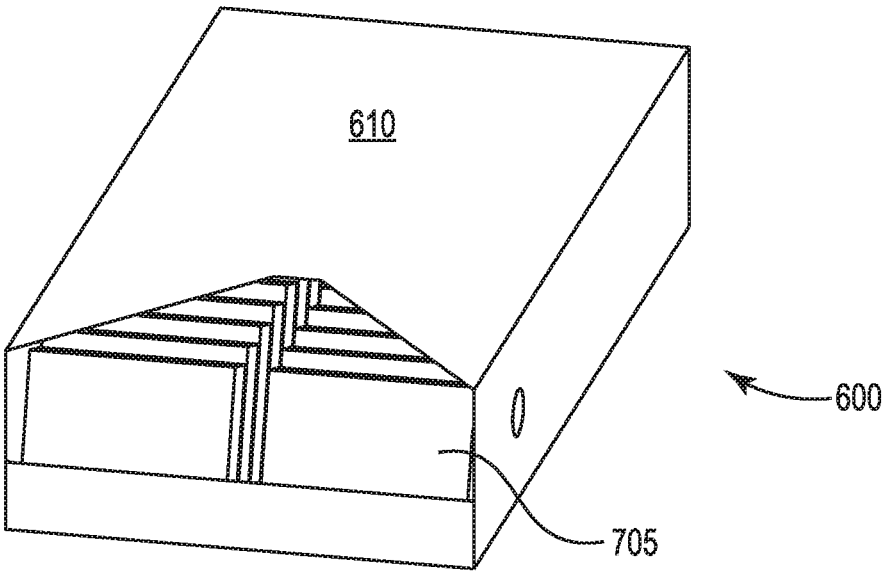
FIG. 7 is a perspective view of an embodiment of a shipping container after conversion to a display container.

FIG. 7 a perspective view of shipping container 600 after removal of removable section 616 from top panel 610, together with major flap 612. Product 705 is visible and may be easily removed from shipping container 600, which now has been converted to a display container.

Figure 8:
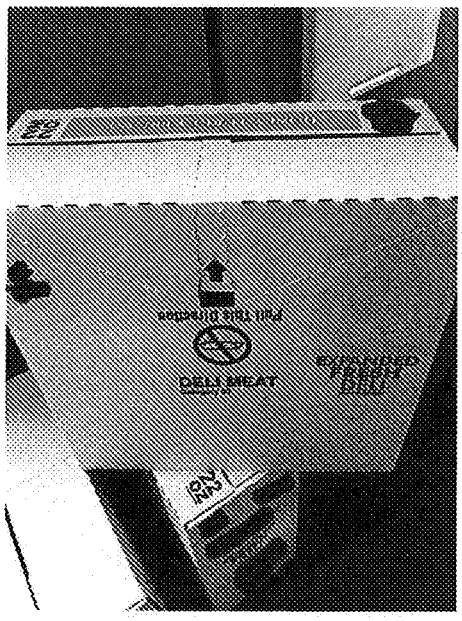
FIG. 8 is a photograph of a perspective view of an embodiment of a shipping container after assembly.

FIG. 8 is a photograph of a perspective view of an embodiment of a shipping container after assembly.

Figure 9:
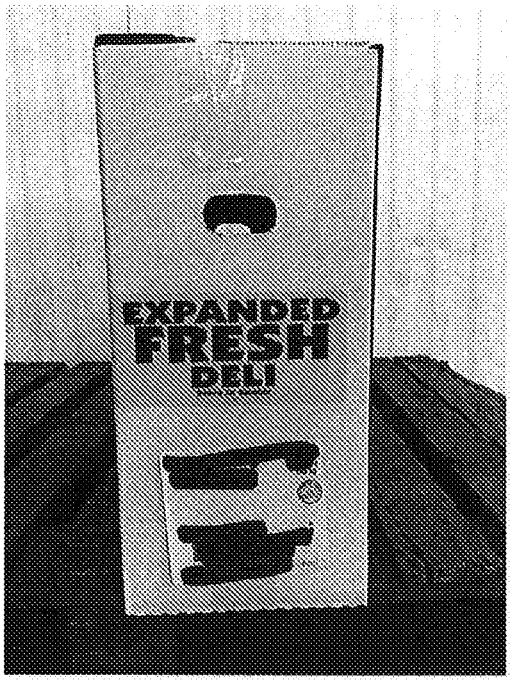
FIG. 9 is a photograph of a side view of an embodiment of a shipping container after assembly.

FIG. 9 is a photograph of a side view of an embodiment of a shipping container after assembly.

Figure 10:
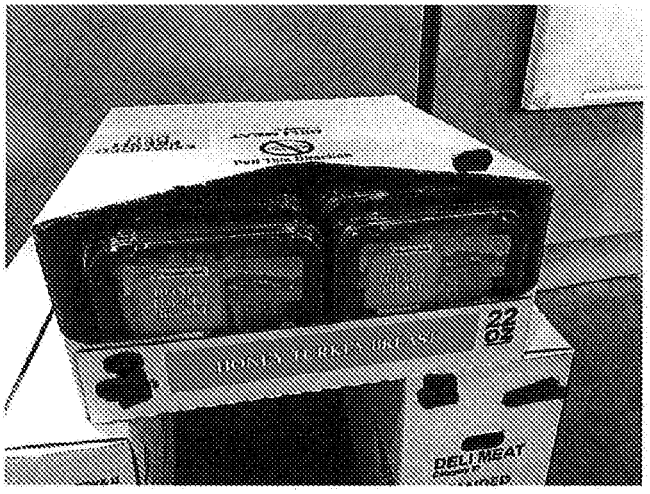
FIG. 10 is a photograph of a perspective view of an embodiment of a shipping container after conversion to a display container.

FIG. 10 is a photograph of a perspective view of an embodiment of a shipping container after conversion to a display container.

Figure 11:
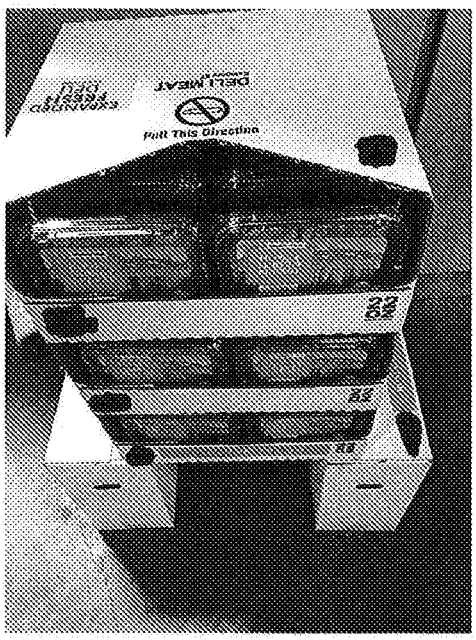
FIG. 11 is a photograph of a perspective view of a stack of an embodiment of shipping containers after conversion to display containers.

FIG. 11 is a photograph of a perspective view of a stack of an embodiment of shipping containers after conversion to display containers.

In an aspect, the product provided in the present shipping container is provided in individual packages, such as boxes or trays. In an aspect, the product is provided in individual packages, such as boxes or trays, with labels oriented to be visible in the container after removal of the detachable portion of the container. In an aspect, the product is a provided in a sealed tray container. In an aspect, the product is provided in individual packages, such as boxes or trays, having transparent or translucent portions, so that the product is visible through the individual packages. In an aspect, the product is a food product provided in a sealed tray container. In an aspect, the product is a meat product. In aspect, the product is a meat product provided in a sealed tray container. In an aspect, the product is a pre-sliced meat product, otherwise known as "deli meat."

In an aspect, products provided in a sealed tray container may be prone to settling during shipping and handling. Such products may be adversely affected if transported and/or stored for long periods of time on end of the sealed tray container. In an aspect, such products are loaded into the present shipping container with the sealed tray container being oriented so that the bottom of the tray faces toward the second major flap 514 and second minor flap 524. The shipping containers in FIGS. 8 and 9 are shown in this orientation. In an embodiment, the shipping container may be marked with an indication "this side up" to provide proper orientation of product during transportation, which is different from the orientation of the shipping container after it has been converted to a display container.

The shipping container may fabricated from any suitable material, such as paper, paperboard and/or corrugated paperboard material. In an aspect, the shipping is fabricated from corrugated paperboard material. In an aspect, the flutes of the corrugated material of the container are oriented such that the flutes of the major and minor flaps are horizontally oriented when the container is in display orientation, i.e. when the bottom panel rests on a horizontal surface. It has been discovered that this orientation provides particularly excellent beam strength characteristics to support the internal load and the ability to stack several cases on top of each other during product display.

Throughout this specification and claims, unless the context requires otherwise, the word "comprise", and variations such as "comprises" and "comprising", will be understood to imply the inclusion of a stated integer or step or group of integers or steps but not the exclusion of any other integer or step or group of integer or step. When used herein "consisting of" excludes any element, step, or ingredient not specified in the claim element. When used herein, "consisting essentially of" does not exclude materials or steps that do not materially affect the basic and novel characteristics of the claim. In the present disclosure of various embodiments, any of the terms "comprising", "consisting essentially of" and "consisting of" used in the description of an embodiment may be replaced with either of the other two terms.

All patents, patent applications (including provisional applications), and publications cited herein are incorporated by reference as if individually incorporated for all purposes. Unless otherwise indicated, all parts and percentages are by weight and all molecular weights are weight average molecular weights. The foregoing detailed description has been given for clarity of understanding only. No unnecessary limitations are to be understood therefrom. The invention is not limited to the exact details shown and described, for variations obvious to one skilled in the art will be included within the invention defined by the claims.

What is claimed is:

1. A shipping container convertible to a display container comprising, a top panel, a bottom panel, a first side panel bridging the top panel and the bottom panel, a second side panel bridging the top panel and the bottom panel;

a first major flap and a second major flap extending from opposing sides of the top panel, a first minor flap and a second minor flap extending from opposing sides of the bottom panel, wherein the first and second major flaps are longer than the first and second minor flaps;

a first side flap and a second side flap extending from opposing sides of the first side panel, a third side flap and a fourth side flap extending from opposing sides of the second side panel;

the container comprising a detachable portion comprising a removable section of the top panel that is no more than 35% of the area of the top panel, the first major flap, and a removable section of the first and third side flaps, wherein the first and second side panels are not separable from the container.

2. The shipping container of claim 1, wherein the removable section of the top panels are from about 10% to about 35% of the area of the top panel.

3. The shipping container of claim 1, wherein the removable section of the top panels are from about 15% to about 35% of the area of the top panel.

4. The shipping container of claim 1, wherein the removable section of the top panels are from about 20% to about 35% of the area of the top panel.

5. The shipping container of claim 1, wherein the removable section of the top panels as described herein has the shape of a triangle.

6. The shipping container of claim 1, wherein the removable section of the top panels as described herein has the shape of a trapezoid.

7. The shipping container of claim 1, wherein the removable section of the top panel is defined by a line of weakness that is a perforation.

8. The shipping container of claim 1, wherein the removable section of the top panels is defined by a line of weakness on the top panel that extends from the intersection of top panel with the side panels and first major flap at angles from the edge of the side panels of greater than about 10 degrees.

9. The shipping container of claim 1, wherein the removable section of the top panels is defined by a line of weakness on the top panel that extends from the intersection of top panel with the side panels and first major flap at angles from the edge of the side panels of from about 10 degrees to about 75 degrees.

10. The shipping container of claim 1, further comprising an additional line of weakness in the first major flap and the removable section of the top panel to assist in removal of the detachable portion.

11. The shipping container of claim 10, wherein the additional line of weakness is a zipper pull.

12. The shipping container of claim 1, wherein the length ratio of the first major flap to the first minor flap is from 1:0.4 to 1:0.9.

13. The shipping container of claim 1, wherein the container is filled with product provided in individual packages.

14. The shipping container of claim 13, wherein the product is a food product.

15. The shipping container of claim 14, wherein the food product is pre-sliced meat.

16. A method of displaying product comprising,

Providing shipping container of claim 13;

Positioning the shipping container so that the bottom panel rests on a generally horizontal surface;

Converting the shipping container to a display container configuration by removing the detachable portion from the shipping container.

17. The method of claim 16, further comprising stacking the display container on top of an additional display container.

18. The method of claim 17, wherein the display container is stacked on additional display container to provide a stack of from two to ten containers high, all with the detachable portion being removed.

* * * * *